US008421578B2

(12) United States Patent
Huang et al.

(10) Patent No.: US 8,421,578 B2
(45) Date of Patent: Apr. 16, 2013

(54) MAGNETIC DEVICE AND METHOD FOR GENERATING INDUCTANCE

(75) Inventors: Zhi Huang, Shanghai (CN); Jiang Chu, Shanghai (CN); Zeng Li, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/241,225

(22) Filed: Sep. 23, 2011

(65) Prior Publication Data

US 2012/0293293 A1 Nov. 22, 2012

(30) Foreign Application Priority Data

May 16, 2011 (CN) ..... 2011 1 0125631

(51) Int. Cl.
*H01F 27/24* (2006.01)
*H01F 17/04* (2006.01)

(52) U.S. Cl.
USPC ..... 336/212; 336/214; 336/221

(58) Field of Classification Search ..... 336/212, 336/214, 215, 216, 221, 232
See application file for complete search history.

(56) References Cited

U.S. PATENT DOCUMENTS 2,064,771 A * 12/1936 Vogt ..... 336/185
4,327,348 A * 4/1982 Hirayama ..... 336/184
5,003,277 A * 3/1991 Sokai et al. ..... 336/10
5,155,676 A * 10/1992 Spreen ..... 363/126
5,182,535 A * 1/1993 Dhyanchand ..... 336/12
7,136,293 B2 * 11/2006 Petkov et al. ..... 363/126
7,332,992 B2 * 2/2008 Iwai ..... 336/170
7,417,875 B2 * 8/2008 Chandrasekaran et al. .... 363/17
7,456,719 B2 * 11/2008 Suzuki et al. ..... 336/198
7,605,682 B2 * 10/2009 Nakao et al. ..... 336/200
7,633,369 B2 * 12/2009 Chandrasekaran et al. .. 336/212
7,876,191 B2 * 1/2011 Chandrasekaran et al. .. 336/212
8,134,443 B2 * 3/2012 Chandrasekaran et al. .. 336/212
8,159,323 B2 * 4/2012 Sugimura et al. ..... 336/221
8,325,004 B2 * 12/2012 Nagano et al. ..... 336/221
2008/0024259 A1 1/2008 Chandrasekaran et al.
2010/0194306 A1 * 8/2010 Sugimura et al. ..... 315/291

FOREIGN PATENT DOCUMENTS

WO 2011019712 A1 2/2011

* cited by examiner

*Primary Examiner* — Mohamad Musleh
*Assistant Examiner* — Joselito Baisa
(74) *Attorney, Agent, or Firm* — CKC & Partners Co., Ltd.

(57) ABSTRACT

A magnetic device includes two symmetric magnetic cores, each of which includes a base, a first protruding portion and second protruding portions. The first protruding portion and the second protruding portions are formed on the base separately along two edges of the base. The two symmetric magnetic cores are assembled such that a gap is formed between the first protruding portion of one of the two symmetric magnetic cores and the first protruding portion of the other one of the two symmetric magnetic cores. A method for generating inductance is also disclosed herein.

25 Claims, 19 Drawing Sheets

Y-Z plane

X-Y plane

| configuration | phase inductance (nH) | Irat (A) | L1 (nH) | L2 (nH) | L3 (nH) | DCR (mΩ) | size (mm) | power density ($A/mm^3$) |
|---|---|---|---|---|---|---|---|---|
|  | 50 | 40 | 360 | 440 | 360 | 0.53 | 27.5*8.25*5 | 0.106 |
|  | 50 | 50 | 380 | 400 | 380 | 0.28 | 35*11*5 | 0.078 |
|  | 50 | 50 | 460 | 500 | 460 | 0.32 | 26*11*5 | 0.105 |
|  | 50 | 50 | 400 | 440 | 400 | 0.25 | 27*9*5 | 0.123 |

MAGNETIC DEVICE AND METHOD FOR GENERATING INDUCTANCE

RELATED APPLICATIONS

This application claims priority to China Patent Application Serial Number 201110125631.2, filed May 16, 2011, which is herein incorporated by reference.

BACKGROUND

1. Technical Field

The present disclosure relates to a magnetic device. More particularly, the present disclosure relates to a magnetic device in a voltage module.

2. Description of Related Art

In order to meet the needs of low voltage and large current required in modern electronic products, voltage regulator modules (VRM) (also referred to as voltage converters) usually have to convert a high voltage into different low voltages for powering various devices (e.g., a central processing unit). Conventionally, a magnetic device (e.g., an inductor) is an essential component in a VRM, and its volume, conduction loss, inductance, etc., are major factors which affect operating characteristics of the VRM, such as current ripple, efficiency, dynamic operating speed, etc. In practice, integrated magnetics can be utilized for fabrication of the magnetic device, such that the volume of the magnetic device can be reduced and performance of the VRM can be improved.

However, a conventional magnetic device typically has several leakage inductance paths therein during operation, such that the leakage inductances of the whole coupled inductance is too large, further resulting in an increase in conduction losses of windings.

Moreover, the leakage inductances generated by the conventional magnetic device cannot be effectively concentrated, so that the leakage inductances are distributed non-uniformly, thus causing ripples of output voltages of a VRM to be increased significantly.

In addition to the technique of adopting integrated magnetics to generate mutual inductance coupling, auxiliary windings can also be used to generate inductance coupling. However, even though the technique of utilizing auxiliary windings can help balance the current generated by each inductor and reduce current ripples, utilizing such a technique may cause an additional problem of conduction losses of windings.

SUMMARY

The present disclosure is to provide a magnetic device having symmetric structures, in which the magnetic device is able to carry a larger current with the same volume, provide a small direct-current resistance to decrease conduction losses of windings, and keep the same equivalent leakage inductance of each phase when the number of windings or structures increases along with an increase in inductance paths, so as to significantly reduce ripples of the output voltages.

An aspect of the present invention is to provide a magnetic device. The magnetic device comprises two symmetric magnetic cores, and each of the two symmetric magnetic cores comprises a base, a first protruding portion and a plurality of second protruding portions. The first protruding portion and the second protruding portions are formed on the base separately along two edges of the base. The two symmetric magnetic cores are assembled such that a gap is formed between the first protruding portion of one of the two symmetric magnetic cores and the first protruding portion of the other one of the two symmetric magnetic cores.

In accordance with one embodiment of the present invention, the first protruding portion is disposed extending along a direction that the second protruding portions are arranged and is longer than each of the second protruding portions.

In accordance with another embodiment of the present invention, each of the second protruding portions is wider than the first protruding portion.

In accordance with yet another embodiment of the present invention, a distal surface area of the first protruding portion is larger than a distal surface area of each of the second protruding portions.

In accordance with still another embodiment of the present invention, distal surface areas of the second protruding portions are the same.

Another aspect of the present invention is to provide a magnetic device. The magnetic device comprises two symmetric magnetic cores, a plurality of windings, and a member with low magnetic permeability. Each of the two symmetric magnetic cores comprises a first protruding portion and a plurality of second protruding portions, and the first protruding portion is disposed extending along a direction that the second protruding portions are arranged. The windings surround the second protruding portions respectively. The member with low magnetic permeability is disposed between the first protruding portion of one of the two symmetric magnetic cores and the first protruding portion of the other one of the two symmetric magnetic cores.

In accordance with one embodiment of the present invention, the member with low magnetic permeability comprises at least one of a gap and a magnetic particle colloid.

In accordance with another embodiment of the present invention, the first protruding portion is longer than each of the second protruding portions, and each of the second protruding portions is wider than the first protruding portion.

In accordance with yet another embodiment of the present invention, a distal surface area of the first protruding portion is larger than a distal surface area of each of the second protruding portions.

In accordance with still another embodiment of the present invention, the second protruding portions are inductively coupled to the windings to induce magnetizing flux loops and leakage flux loops, and the magnetizing flux loops and the leakage flux loops are located in two different intersected planes.

In accordance with still yet another embodiment of the present invention, the second protruding portions are inductively coupled to the windings to induce magnetizing fluxes, and the magnetizing fluxes are inversely coupled with one another.

In accordance with still yet another embodiment of the present invention, the second protruding portions are inductively coupled to the windings to induce a leakage flux passing through the member with low magnetic permeability.

In accordance with still yet another embodiment of the present invention, any adjacent two of the windings surrounding the second protruding portions have a sub gap therebetween, and a reluctance corresponding to the sub gap is greater than ten times the reluctance corresponding to the member with low magnetic permeability.

Yet another aspect of the present invention is to provide a magnetic device. The magnetic device comprises two symmetric magnetic cores, a plurality of windings and a magnetic particle colloid. Each of the two symmetric magnetic cores comprises a first protruding portion and a plurality of second protruding portions. The first protruding portion is disposed extending along a direction that the second protruding portions are arranged. The first protruding portion is longer than each of the second protruding portions. Each of the second protruding portions is wider than the first protruding portion. The windings surround the second protruding portions respectively. The magnetic particle colloid is disposed between the first protruding portion of one of the two symmetric magnetic cores and the first protruding portion of the other one of the two symmetric magnetic cores.

In accordance with one embodiment of the present invention, a distal surface area of the first protruding portion is larger than a distal surface area of each of the second protruding portions.

In accordance with another embodiment of the present invention, the distal surface areas of the second protruding portions are the same.

In accordance with yet another embodiment of the present invention, the second protruding portions are inductively coupled to the windings to induce magnetizing flux loops and leakage flux loops, and the magnetizing flux loops and the leakage flux loops are located in two different intersected planes.

In accordance with still another embodiment of the present invention, the magnetizing flux loops and the leakage flux loops are located in two perpendicularly intersected planes.

In accordance with still yet another embodiment of the present invention, the second protruding portions are inductively coupled to the windings to induce magnetizing fluxes, and the magnetizing fluxes are inversely coupled with one another.

In accordance with still yet another embodiment of the present invention, the second protruding portions are inductively coupled to the windings to induce a leakage flux passing through the member with low magnetic permeability.

Still yet another aspect of the present invention is to provide a method for generating inductance, and the method comprises steps outlined below. A plurality of magnetizing flux loops are induced, in which magnetizing fluxes in any two of the magnetizing flux loops are inversely coupled to each other. Leakage flux loops are induced, and a plane in which the leakage flux loops are located is different from and intersected with a plane in which the magnetizing flux loops are located.

In accordance with one embodiment of the present invention, the magnetizing flux loops are induced by two symmetric magnetic cores of a magnetic device and a plurality of windings surrounding the two symmetric magnetic cores, and the leakage flux loops pass through a member with low magnetic permeability and which is disposed between the two symmetric magnetic cores of the magnetic device.

In accordance with another embodiment of the present invention, the plane in which the leakage flux loops are located is perpendicularly intersected with the plane in which the magnetizing flux loops are located.

Still yet another aspect of the present invention is to provide a method for generating inductance, and the method comprises steps outlined below. A plurality of protruding portions of two symmetric magnetic cores are coupled inductively to a plurality of windings surrounding the protruding portions to induce a plurality of magnetizing flux loops, in which magnetizing fluxes in any two of the magnetizing flux loops are inversely coupled to each other. The protruding portions of the two symmetric magnetic cores are coupled inductively to the windings to induce leakage flux loops, in which the leakage flux loops and the magnetizing flux loops are located in two different intersected planes.

In accordance with one embodiment of the present invention, the leakage flux loops and the magnetizing flux loops are located in two perpendicularly intersected planes.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiments, with reference to the accompanying drawings as follows.

DESCRIPTION OF THE EMBODIMENTS

Figure 1:
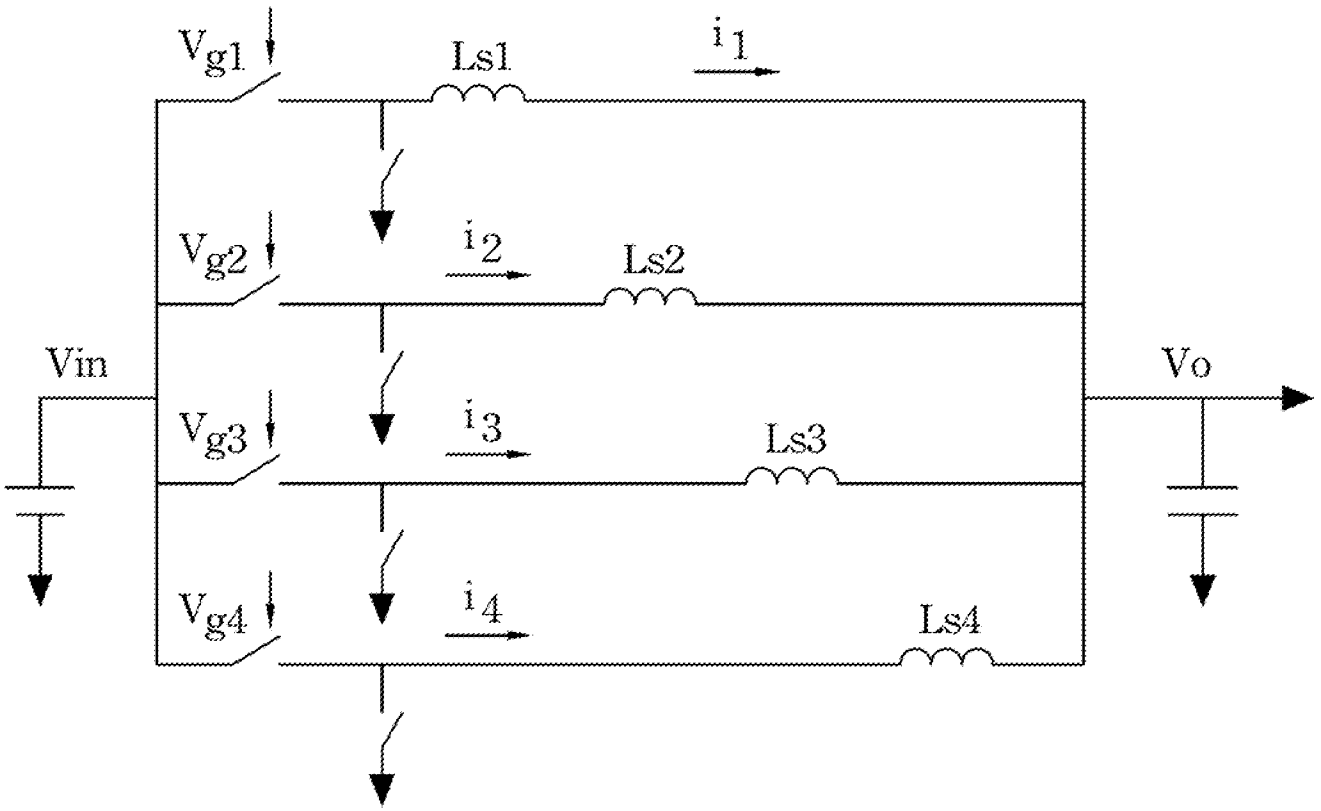
FIG. 1 is a diagram illustrating a circuit configuration of a voltage regulator module (VRM)

In the following description, several specific details are presented to provide a thorough understanding of the embodiments of the present invention. One skilled in the relevant art will recognize, however, that the present invention can be practiced without one or more of the specific details, or in combination with or with other components, etc. In other instances, well-known implementations or operations are not shown or described in detail to avoid obscuring aspects of various embodiments of the present invention.

The terms used in this specification generally have their ordinary meanings in the art and in the specific context where each term is used. The use of examples anywhere in this specification, including examples of any terms discussed herein, is illustrative only, and in no way limits the scope and meaning of the invention or of any exemplified term. Likewise, the present invention is not limited to various embodiments given in this specification.

As used herein, the terms "comprising," "including," "having," "containing," "involving," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present invention. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

For purposes of clear illustration, terms and related skills in the present disclosure are described below. According to standard definitions utilized in the field related to coupled inductors, each winding of the coupled inductor has a constant inductance, which is referred to as "self-inductance," when measured in a state where other windings are open-circuited or not conducted. The self-inductance may be separated into two parts, in which the magnetic flux corresponding to one part of the inductance passes through cross sections of the other windings to be coupled with the other windings and thus can be referred to as "magnetizing inductance" ($L_m$), and the other part of the inductance has no coupling with the other windings and thus can be referred to as "leakage inductance" ($L_K$). Under normal conditions, the magnetizing inductance is far larger than the leakage inductance. By controlling the ratio of the magnetizing inductance to the leakage inductance and values of both, waveforms and values of current ripples corresponding to each winding can thus be changed.

Since the magnetic flux which corresponds to the magnetizing inductance of each winding passes through the other windings, "inversely coupling" will happen if the direction of the magnetic flux, which corresponds to the magnetizing inductance of the other windings and passes through the present winding, is opposite to the direction of the magnetic flux which is generated by the present winding itself, and direct-current (DC) components of the magnetic fluxes which correspond to the magnetizing inductances of the windings will counterbalance each other. As a result, the magnetizing inductance is not affected by offset of a DC current. As for the leakage inductance, there is no effect of DC counterbalancing but a problem of DC saturation. In regard to this problem, a gap (usually referred to as a main gap) is conventionally designed in the magnetic flux path which corresponds to the leakage inductance, so as to avoid saturation.

FIG. 1 is a diagram illustrating a circuit configuration of a voltage regulator module (VRM). FIGS. 2A-2D are diagrams of current variations corresponding to control signals under different conditions in the VRM shown in FIG. 1. Referring to FIG. 1 and FIGS. 2A-2D, the circuit configuration of the VRM adopts a multiphase interleaved parallel architecture in which the switches corresponding to the currents (e.g., $i_1$, $i_2$, $i_3$, $i_4$) are alternately turned on with the control signals (e.g., $V_{g1}$, $V_{g2}$, $V_{g3}$, $V_{g4}$), such that phases of the currents flowing through the inductors (e.g., Ls1, Ls2, Ls3, Ls4) are interleaved to have angle differences from each other, so as to cancel current ripples by the phase interleaving technique, thus effectively reducing the output ripples and improving the dynamic response speed.

Figure 2A:
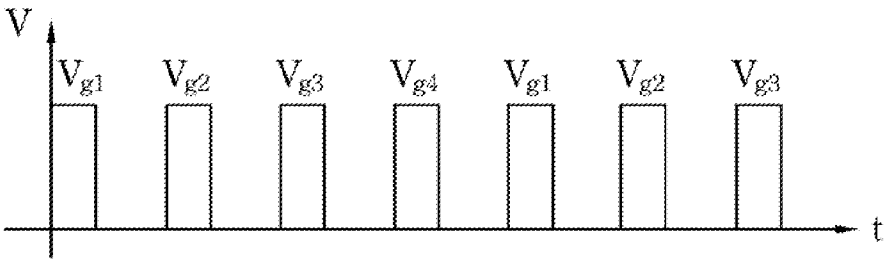
FIGS. 2A-2D are diagrams of current variations corresponding to control signals under different conditions in the VRM shown in FIG. 1.
Figure 2B:
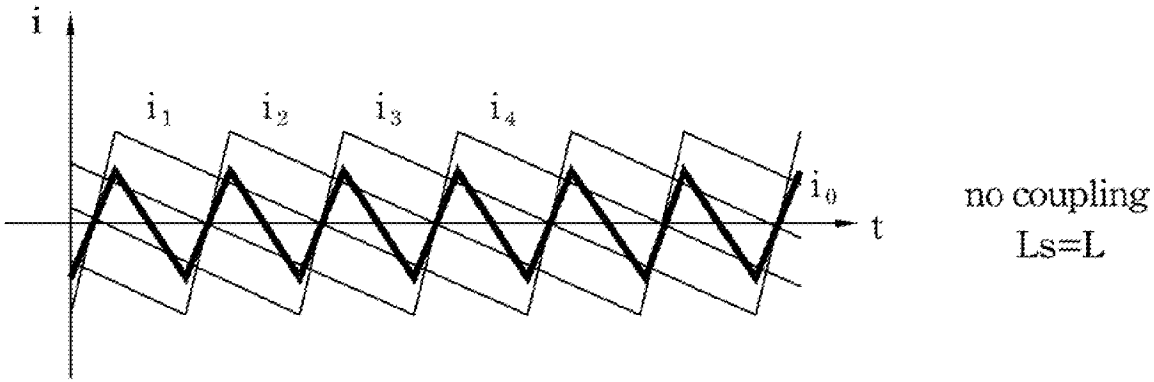
Figure 2C:
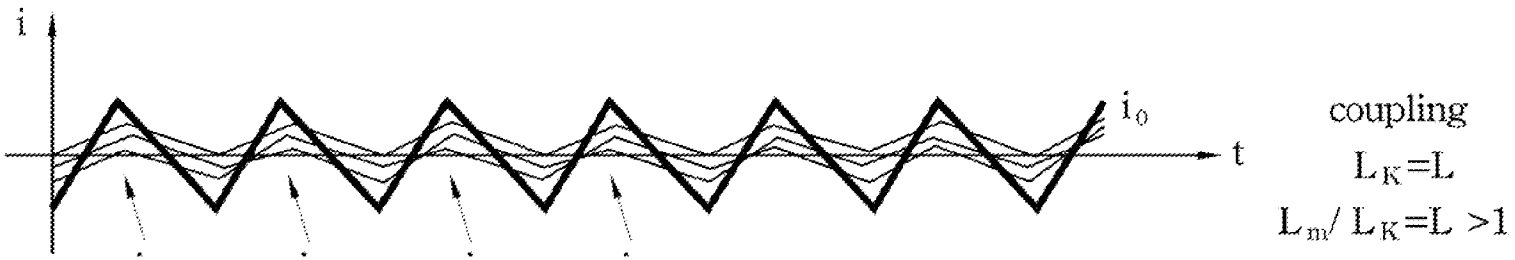

However, as illustrated in FIG. 2B, for each path (or phase) of current, there will be no ripple cancellation if there is no coupling effect, and thus conduction losses of the switches may still be significant. However, if there is inversely coupling associated with the inductance of each phase, the current ripple in each phase may be significantly reduced, to further reduce the conduction losses of the switches and improve efficiency. As illustrated in FIG. 2C, if the leakage inductance $L_K$ of the coupled inductor is equal to an inductance $L_S$ of a single non-coupled inductor, the dynamic response in which output current ripples are the same can be obtained.

Figure 2D:
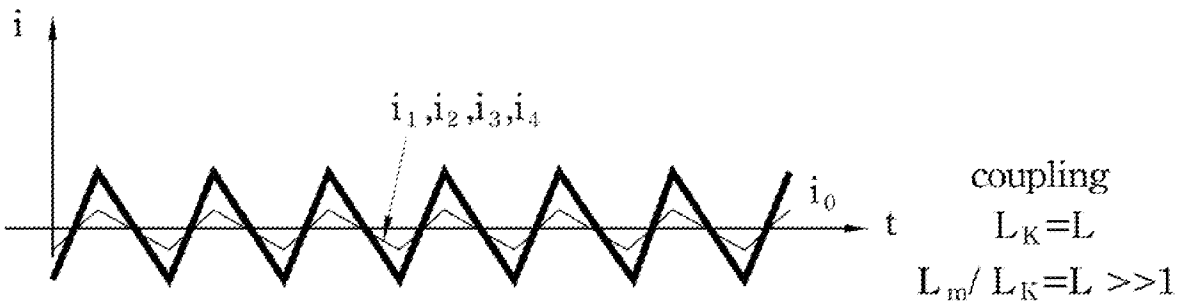

Furthermore, as illustrated in FIG. 2D, an increase in the magnetizing inductance $L_m$ of the coupled inductor contributes to a decrease in current ripples. Under ideal conditions, when the magnetizing inductance $L_m$ approaches infinity, the waveforms of the current ripples in the phases increasingly become the same, and the current ripples can thus be reduced to a minimum level.

As described above, for realizing better performance of the coupled inductor when the coupled inductor is operated, the magnetizing inductance $L_m$ of the coupled inductor has to be increased as much as possible with the same leakage inductance $L_K$ within the coupled inductor.

An aspect of the present invention is to provide a magnetic device so that the magnetizing inductance $L_m$ can be significantly increased. The magnetic device includes at least two symmetric magnetic cores, in which each of the two symmetric magnetic cores includes a base, a first protruding portion and a plurality of second protruding portions. The first protruding portion and the second protruding portions are formed on the base separately along two edges of the base.

Figure 3:
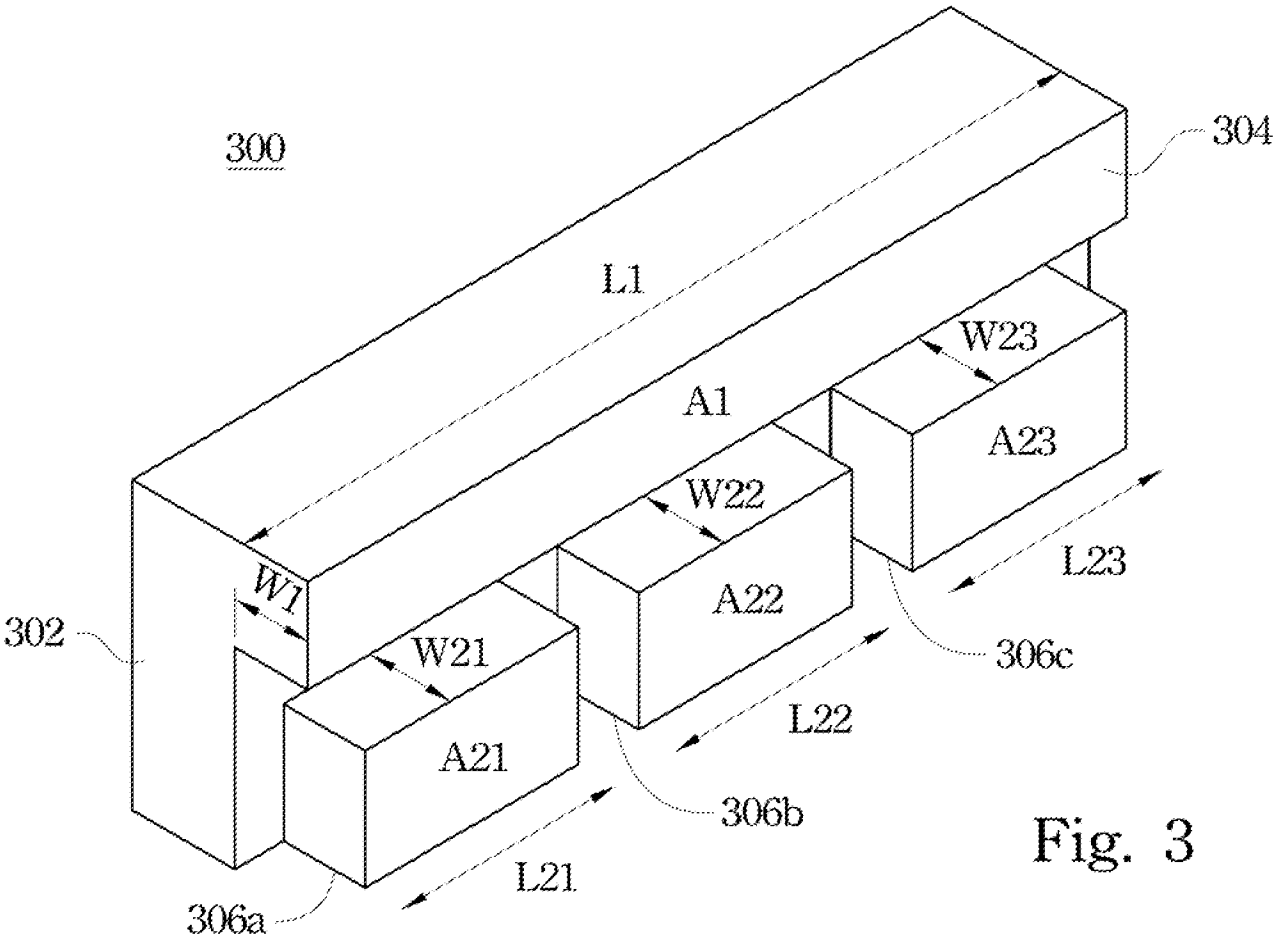
FIG. 3 is a diagram illustrating a perspective view of a magnetic core according to one embodiment of the present invention.

FIG. 3 is a diagram illustrating a perspective view of a magnetic core according to one embodiment of the present invention. As shown in FIG. 3, a magnetic core 300 includes a base 302, a first protruding portion 304 and second protruding portions 306*a*, 306*b*, 306*c*, in which the first protruding portion 304 and the second protruding portions 306*a*, 306*b*, 306*c* are formed on the base 302 separately along two edges of the base 302 and are separated by a distance. Moreover, any two adjacent second protruding portions 306*a*, 306*b*, 306*c* are also separated by a distance such that the second protruding portions 306*a*, 306*b*, 306*c* have sufficient spaces therebetween for windings. The distance between the first protruding portion 304 and second protruding portions 306*a*, 306*b*, 306*c*, or the distance between two adjacent second protruding portions 306*a*, 306*b*, 306*c*, is well known or can be selected by persons of ordinary skill in the art as required, and thus is not defined in detail herein.

In practice, the magnetic core 300 can be formed in one piece and also can be manufactured by separately forming the base 302, the first protruding portion 304 and the second protruding portions 306*a*, 306*b*, 306*c*. For purposes of illustration, FIG. 3 illustrates three of the second protruding portions 306*a*, 306*b*, 306*c* but the present invention is not limited thereto. In other words, persons of ordinary skill in the art may choose to utilize an appropriate number of second protruding portions based on particular requirements.

In one embodiment of the present invention, a magnetic device (e.g., a coupled inductor) is provided and includes at least two magnetic cores 300 which are symmetric to each other. After being assembled in a symmetric manner, a main gap 310 (shown in FIG. 5) is formed between the first protruding portion 304 of one of the magnetic cores 300 and the first protruding portion 304 of the other one of the magnetic cores 300, such that the main gap 310 is formed above the windings in the magnetic device so as to function as a magnetic flux path for the leakage inductance $L_K$, helping to concentrate the magnetic flux corresponding the leakage inductance $L_K$.

In one embodiment, the first protruding portion 304 may be disposed extending along a direction that the second protruding portions 306*a*, 306*b*, 306*c* are arranged, and may be longer than each of the second protruding portions 306*a*, 306*b*, 306*c*. Specifically, as shown in FIG. 3, the length of the first protruding portion 304, i.e., L1, is longer than the lengths of each of the second protruding portions 306*a*, 306*b*, 306*c*, i.e., L21, L22, L23.

Figure 5:
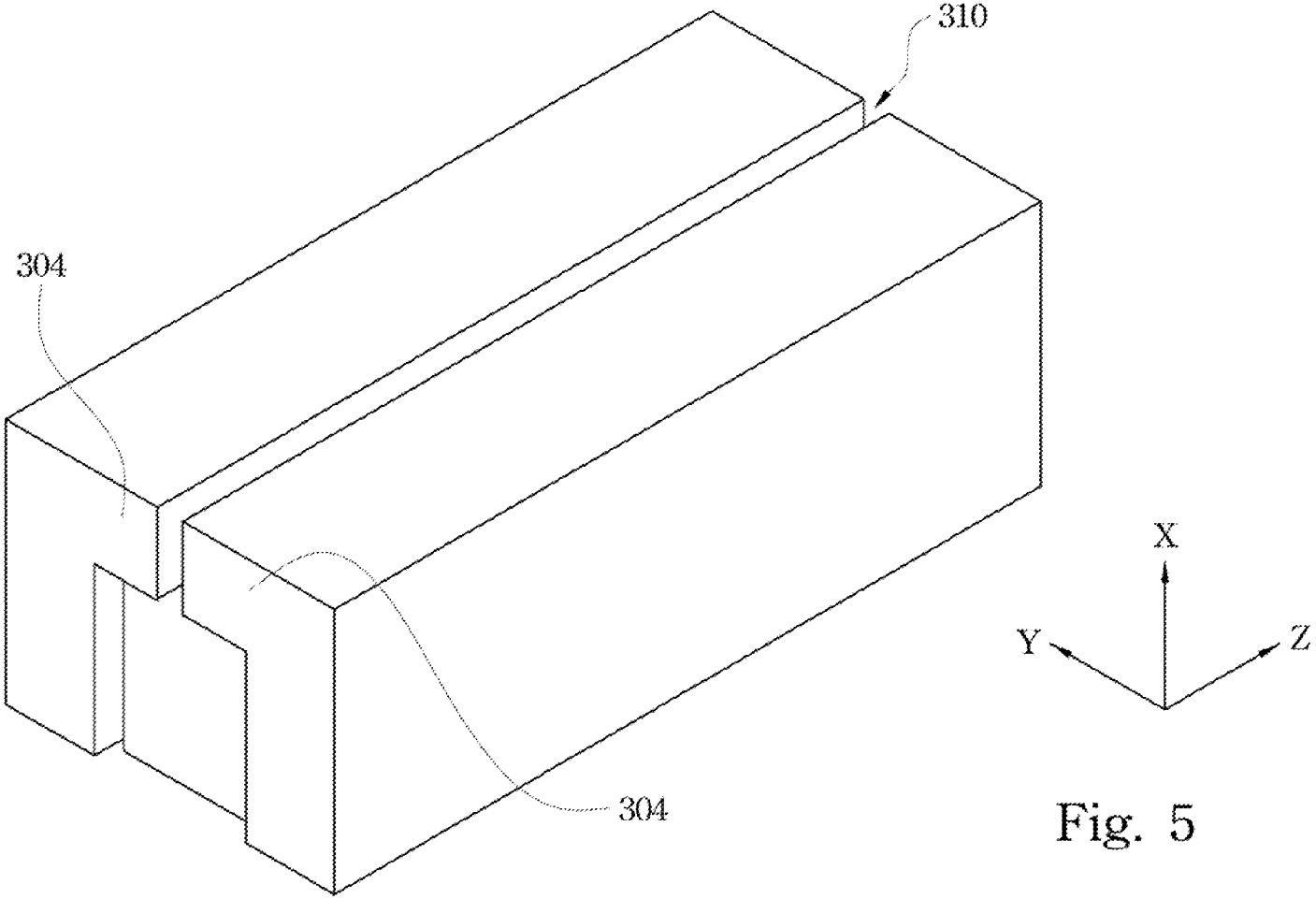
FIG. 5 is a diagram illustrating a perspective view of a magnetic device according to one embodiment of the present invention.

In another embodiment, each of the second protruding portions 306*a*, 306*b*, 306*c* may be wider than the first protruding portion 304. Specifically, as shown in FIG. 3, each of the widths W21, W22, W23 of the second protruding portions 306*a*, 306*b*, 306*c* is larger than the width W1 of the first protruding portion 304. Consequently, when the two symmetric magnetic cores 300 are assembled, the main gap 310 (as shown in FIG. 5) can be formed in the assembly.

In yet another embodiment, a distal surface area of the first protruding portion 304 may be larger than a distal surface area of each of the second protruding portions 306*a*, 306*b*, 306*c*. Specifically, as shown in FIG. 3, the distal surface area A1 is larger than the distal surface area A21, A22, A23 of each of the second protruding portions 306*a*, 306*b*, 306*c*. The "distal surface" for each of the first and second protruding portions 304, 306*a*, 306*b*, 306*c* refers to the surface thereof opposite to the surface attached to the base 302. Moreover, the distal surface areas A21, A22, A23 of the second protruding portions 306*a*, 306*b*, 306*c* can be the same or different according to actual requirements.

In practice, the shapes, volumes, sizes or structures of the second protruding portions 306*a*, 306*b*, 306*c* can be the same or different. Persons of ordinary skill in the art can design second protruding portions that are the same or different according to actual requirements, and thus the foregoing embodiments are not limiting of the present invention.

The magnetic core 300 can be formed having any one or more of the features described in the embodiments mentioned above. For example, each of the second protruding portions 306*a*, 306*b*, 306*c* can be formed to be wider than the first protruding portion 304, and moreover the distal surface area of the first protruding portion 304 can be formed to be larger than the distal surface area of each of the second protruding portions 306*a*, 306*b*, 306*c*. Therefore, the embodiments mentioned above and describing individual features are only for purposes of illustration and are not limiting of the present invention. All of the embodiments can be selectively implemented according to actual requirements so as to produce the magnetic device and the magnetic core thereof in the present invention.

Figure 4:
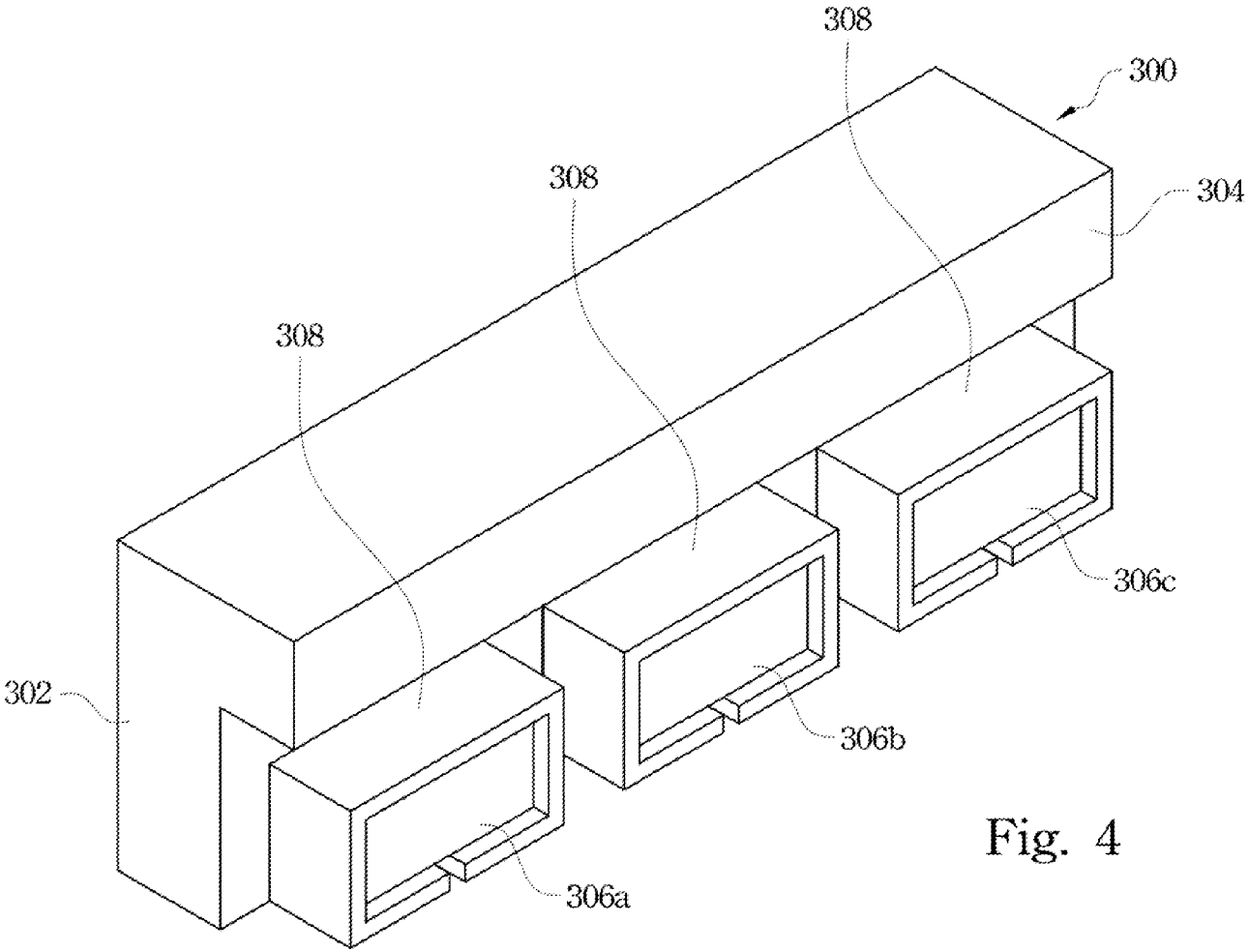
FIG. 4 is a diagram illustrating a perspective view of the magnetic core shown in FIG. 3 and surrounded by windings according to one embodiment of the present invention.

FIG. 4 is a diagram illustrating a perspective view of the magnetic core shown in FIG. 3 and surrounded by windings according to one embodiment of the present invention. As shown in FIG. 4, the magnetic device in one embodiment of the present invention further can include a plurality of windings 308. The windings 308 surround the second protruding portions 306*a*, 306*b*, 306*c* respectively and are inductively coupled to the second protruding portions 306*a*, 306*b*, 306*c* to induce the magnetizing fluxes and the leakage flux when currents are applied thereto. In operation, the magnetizing fluxes induced when the second protruding portions 306*a*, 306*b*, 306*c* are inductively coupled to the windings 308 are inversely coupled to each other.

In practice, the windings 308 can be made of metal material. That is, the windings 308 may be formed using copper foils, copper wires or other metal conductors usually implemented by persons of ordinary skill in the art.

Figure 6A:
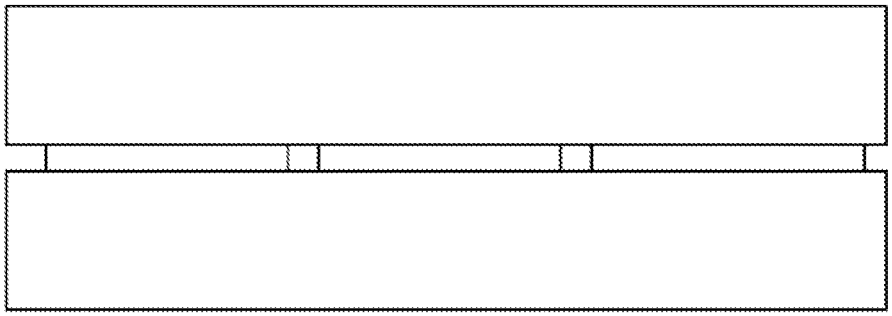
FIG. 6A, FIG. 6B and FIG. 6C are diagrams respectively illustrating a top view, a side view and a front view of the magnetic device shown in FIG. 5.
Figure 6B:
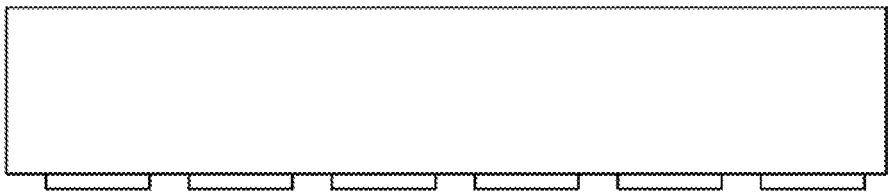
Figure 6C:
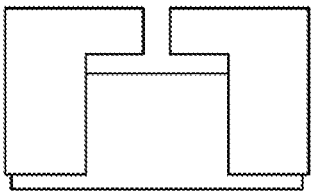

FIG. 5 is a diagram illustrating a perspective view of a magnetic device according to one embodiment of the present invention. As shown in FIG. 5, the magnetic device includes a symmetric assembly of the two magnetic cores 300 shown in FIG. 3, in which the main gap 310 is formed between the first protruding portion 304 of one of the two magnetic cores 300 and the first protruding portion 304 of the other one of the two magnetic cores 300. Notably, the magnetic device shown in FIG. 5 may include windings or no windings; that is, FIG. 5 is only an exemplary diagram and not limiting of the present invention. FIG. 6A, FIG. 6B and FIG. 6C are diagrams respectively illustrating a top view, a side view and a front view of the magnetic device shown in FIG. 5.

Figure 7:
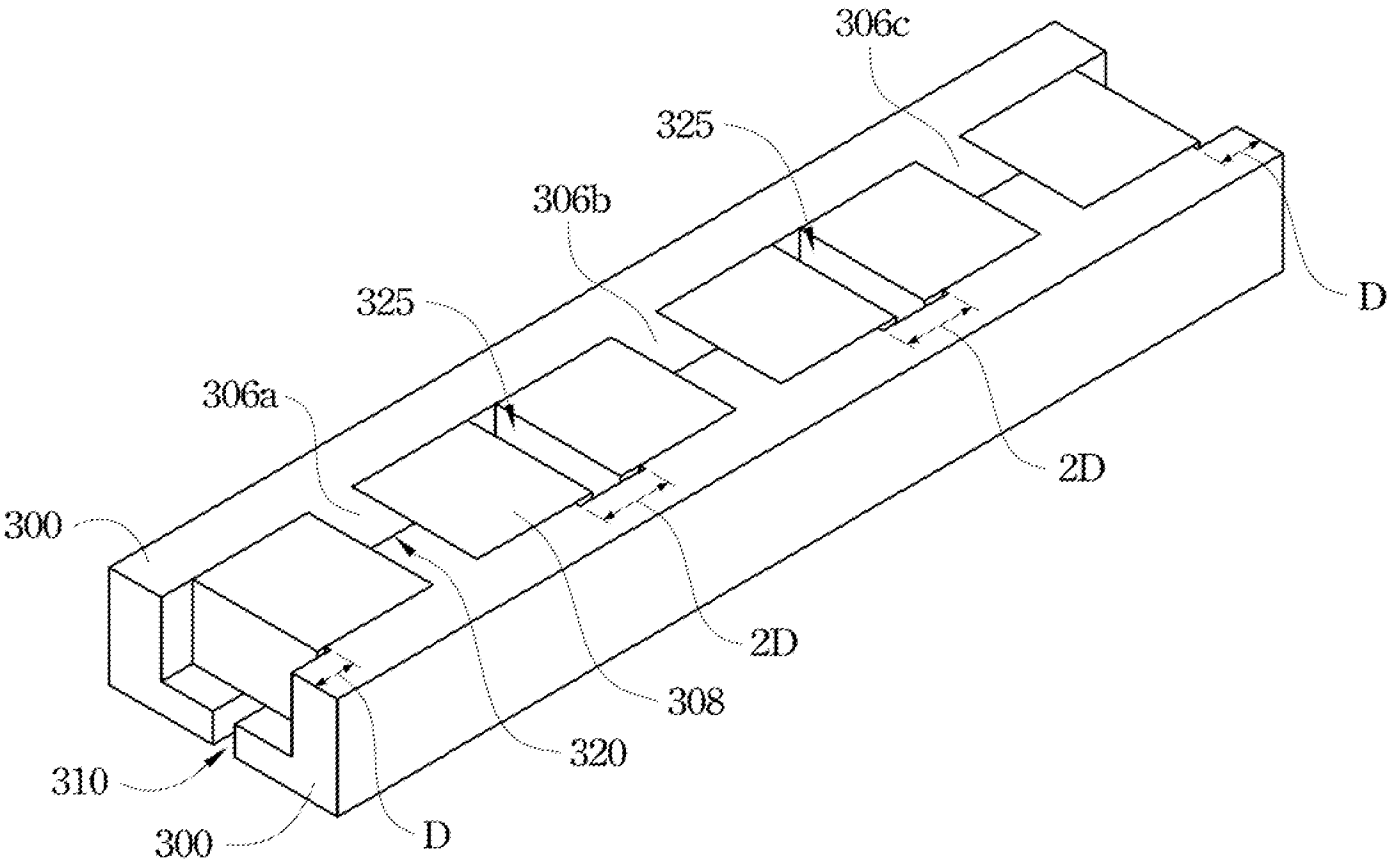
FIG. 7 is a diagram illustrating a bottom view of a magnetic device according to one embodiment of the present invention.

FIG. 7 is a diagram illustrating a bottom view of a magnetic device according to one embodiment of the present invention. As shown in FIG. 7, the magnetic device includes a symmetric assembly of the two magnetic cores 300 shown in FIG. 4, in which a corresponding number of the windings 308 separately surround the second protruding portions 306*a*, 306*b*, 306*c*. As can be seen in FIG. 7, when the two magnetic cores 300 are configured with the windings 308, a small assembly gap 320 exists between the second protruding portions 306*a*, 306*b*, 306*c* of one of the two magnetic cores 300 and the second protruding portions 306*a*, 306*b*, 306*c* of the other one of the two magnetic cores 300, and the size of the assembly gap 320 may directly affect the value of the magnetizing inductance $L_m$. Thus, the smaller the assembly gap 320, the better the performance; preferably, the assembly gap 320 is far smaller than the main gap 310.

In addition to the assembly gap 320 and the main gap 310, there is still a smaller space between two adjacent windings 308 such that a sub gap 325 exists therebetween. Under normal conditions, most of the leakage flux passes through the main gap 310 instead of the sub gap 325 because the sub gap 325 is small such that the reluctance thereof is large, thereby resulting in a small amount of the magnetic flux passing through the sub gap 325. Since most of the leakage flux passes through the main gap 310, the leakage inductance $L_K$ may be modulated by adjusting the length or width of the main gap 310. Moreover, the leakage flux is concentratedly distributed, so the eddy current loss of the windings can be reduced as well.

On the other hand, a value of an output voltage ripple is determined by an equivalent leakage inductance corresponding to each winding, and so in practice, the value of the leakage inductance $L_K$ of the magnetic device (e.g., a coupled inductor) is related to the structure of the magnetic device. A coupled inductor should be designed to have a symmetric structure such that the leakage inductance $L_K$ corresponding to each of the windings can be the same. In the embodiment shown in FIG. 7, any two adjacent windings 308 can be separated from each other by a distance 2D, and the length of each of the magnetic cores 300 can be extended to be longer than the outermost windings 308 respectively by a distance D. Consequently, each of the windings 308 can have the same magnetic cross section relative to the main gap 310, and the difference between the leakage inductance corresponding to the windings 308 is decreased, thus achieving symmetry for the inductance.

Since the structure of the magnetic device in the embodiments of the present invention is symmetric, the magnetic flux can be more uniformly distributed. When the magnetic device shown in FIG. 7 is applied in a circuit similar to that shown in FIG. 1, under conditions where the circuit has a switch frequency of 600 KHz, a total output current of 120 amp (A), an input voltage of 12 volt (V), an output voltage of 1.2 volt (V) and an output capacitance of 250 uF, an output voltage ripple of 7.92 mV of the magnetic device in the embodiments of the present invention can be measured, and this value is 7% less than that measured when a conventional magnetic device having an asymmetric structure is used.

Figure 8A:
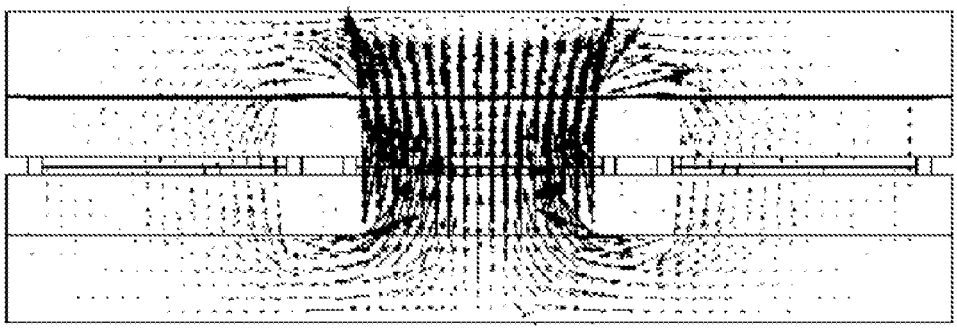
FIG. 8A is a diagram illustrating magnetizing flux loops according to one embodiment of the present invention.
Figure 8B:
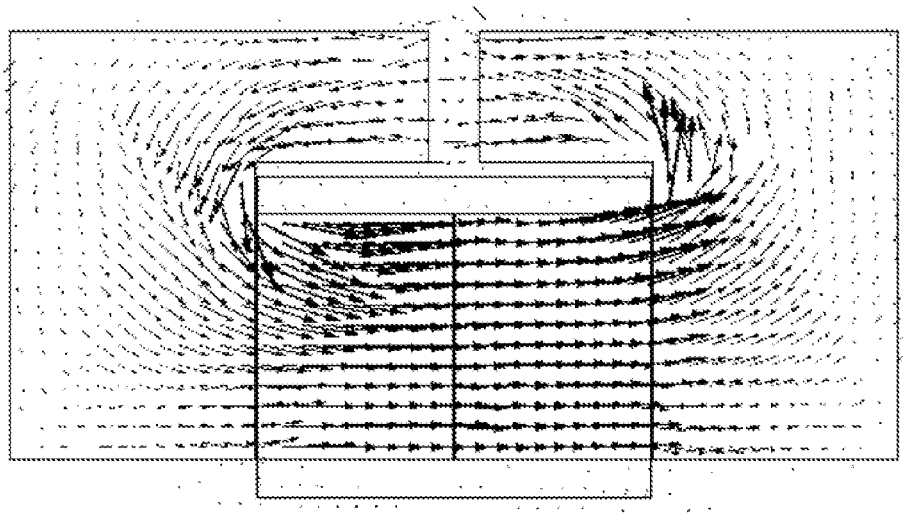
FIG. 8B is a diagram illustrating leakage flux loops according to one embodiment of the present invention.

Furthermore, the magnetizing flux loops and the leakage flux loops, which are induced when the second protruding portions are inductively coupled to the windings, may be located in two different intersected planes. FIG. 8A is a diagram illustrating magnetizing flux loops according to one embodiment of the present invention. FIG. 8B is a diagram illustrating leakage flux loops according to one embodiment of the present invention. Referring to FIG. 4, FIG. 5, FIG. 8A and FIG. 8B, when the magnetic device including the two symmetric magnetic cores 300 and the windings 308 is operated, the magnetizing fluxes induced when the second protruding portions 306*a*, 306*b*, 306*c* are inductively coupled to the windings 308 are inversely coupled with one another, and the leakage flux induced when the second protruding portions 306*a*, 306*b*, 306*c* are inductively coupled to the windings 308 passes through the main gap 310. Thus, the magnetizing flux loops and the leakage flux loops are located in two different intersected planes. Preferably, the magnetizing flux loops are located in the Y-Z plane shown in FIG. 8A, and the leakage flux loops are located in the X-Y plane shown in FIG. 8B. Consequently, the spacing between the windings can be significantly reduced, thus improving the coupling between the windings, and allowing a larger magnetizing inductance $L_m$ to be induced for the same volume.

For a coupled inductor, if the effect of the fill factor of the windings is not considered, the total volume of the inductor basically can be determined by the following formula:

$$VL=Vw+Vg+Vc,$$

where VL is the total volume of an inductor, Vw is the volume of windings, Vg is the volume of a gap, Vc is the volume of magnetic cores, and most of the energy corresponding to the leakage inductance is stored in the gap. For different configurations, the volume Vw of the windings should generally be kept the same if the shapes of the windings are not changed significantly.

For a conventional coupled inductor, the magnetizing inductance $L_m$ is determined by a reluctance $R_m$, where $R_m=I_e/(\mu_0\mu_r A_e)$, of a magnetic path shared by several windings, where $I_e$ is the length of the shared magnetic path, $\mu_0$ is the vacuum permeability, $\mu_r$ is the relative permeability of the magnetic core, and $A_e$ is the cross section area of the shared magnetic path.

In a typical coupled inductor, the leakage inductance $L_K$ and the magnetizing inductance $L_m$ are located in the same plane, so a larger space between two windings is usually necessary for the leakage flux to pass through. As a result, the length $I_e$ of the magnetic path shared by the two windings would directly increase, and thus according to the formula mentioned above, the reluctance $R_m$ of the shared magnetic path would increase with the same values of $\mu_r$ and $A_e$. In other words, the magnetizing inductance $L_m$ ($L_m=N^2/R_m$) between two of the windings would correspondingly decrease. Moreover, an increase of the length $I_e$ of the shared magnetic path would further result in a larger volume ($Vc=A_e \cdot I_e$) of the magnetic core. Therefore, this would result in a situation in which the coupled inductor only can load a small current with a given volume, such that power density cannot be significantly improved.

Compared to the conventional technique mentioned above, the magnetic device disclosed in the embodiments of the present invention has a more symmetric structure such that the distribution of the magnetic flux is more uniform. Moreover, the magnetic fluxes corresponding to the leakage inductance $L_K$ and the magnetizing inductance $L_m$ are not located in the same plane and are preferably perpendicular to each other (as shown in FIG. 8A and FIG. 8B), so there is no need for the gap provided for the leakage flux between the windings and at two sides of the magnetic device. Therefore, the space between the windings and the total length of the magnetic device can be significantly reduced, and the length $I_e$ of the magnetic path between two of the windings can be significantly shortened. In addition, with the same distal surface area $A_e$ of the magnetic path, the volume Vc of the magnetic cores can be reduced and the magnetizing inductance $L_m$ can be improved.

With respect to gap energy storage, when the leakage inductance corresponding to each winding is $L_K$ and the current flowing through the inductor of each phase is I, then the stored energy can be represented by the following equation:

$$(1/2)\cdot L_K \cdot I^2=(B^2/2\mu_0)Vg$$

where B is the density of magnetic flux passing through the gap, which is normally equal to the density of magnetic flux passing through the magnetic core, and Vg is the volume of the gap. As is evident, the value of stored energy determines the volume Vg of the gap, and thus the volume Vg of the gap and the volume Vw of windings are basically kept the same if the stored energy of the gap is kept the same. Consequently, when the volume Vg of the gap and the volume Vw of the windings are constant, the volume of the magnetic device can be determined mainly by the volume Vc of the magnetic core.

In addition, the magnetic core can basically include two portions in which one has a volume Vm for the magnetizing flux and the other has a volume $V_K$ for the leakage flux, and electrical characteristics determine the values of the volumes Vm and Vk. Thus, the larger the ratio of a shared portion of the two portions to the whole magnetic core, the smaller the volume Vc of the magnetic core. For the embodiments shown in FIG. 8A and FIG. 8B, the magnetizing flux loops are located in the Y-Z plane, the leakage flux loops are located in the X-Y plane, and inversely-coupling magnetic fluxes of any two of the second protruding portions of the magnetic core counterbalance each other, so coupling magnetic fluxes would not cause magnetic saturation in the magnetic core. Thus, the volume Vc of the magnetic core basically can be determined by the volume Vm for the magnetizing flux such that the volume Vc of the magnetic core of the magnetic device can be designed to a minimum.

In another aspect of the present invention, the magnetic device includes two symmetric magnetic cores, a plurality of windings and a member with low magnetic permeability (having low magnetic permeability $\mu$). Each of the two symmetric magnetic cores includes a first protruding portion and a plurality of second protruding portions, in which the first protruding portion is disposed extending along a direction that the second protruding portions are arranged. The windings surround the second protruding portions respectively.

The member with low magnetic permeability is disposed between the first protruding portion of one of the two symmetric magnetic cores and the first protruding portion of the other one of the two symmetric magnetic cores.

In one embodiment of the present invention, the member with low magnetic permeability includes at least one of a gap and a magnetic particle colloid; in other words, the member with low magnetic permeability may be a gap, a magnetic particle colloid, or a combination thereof.

Figure 9A:
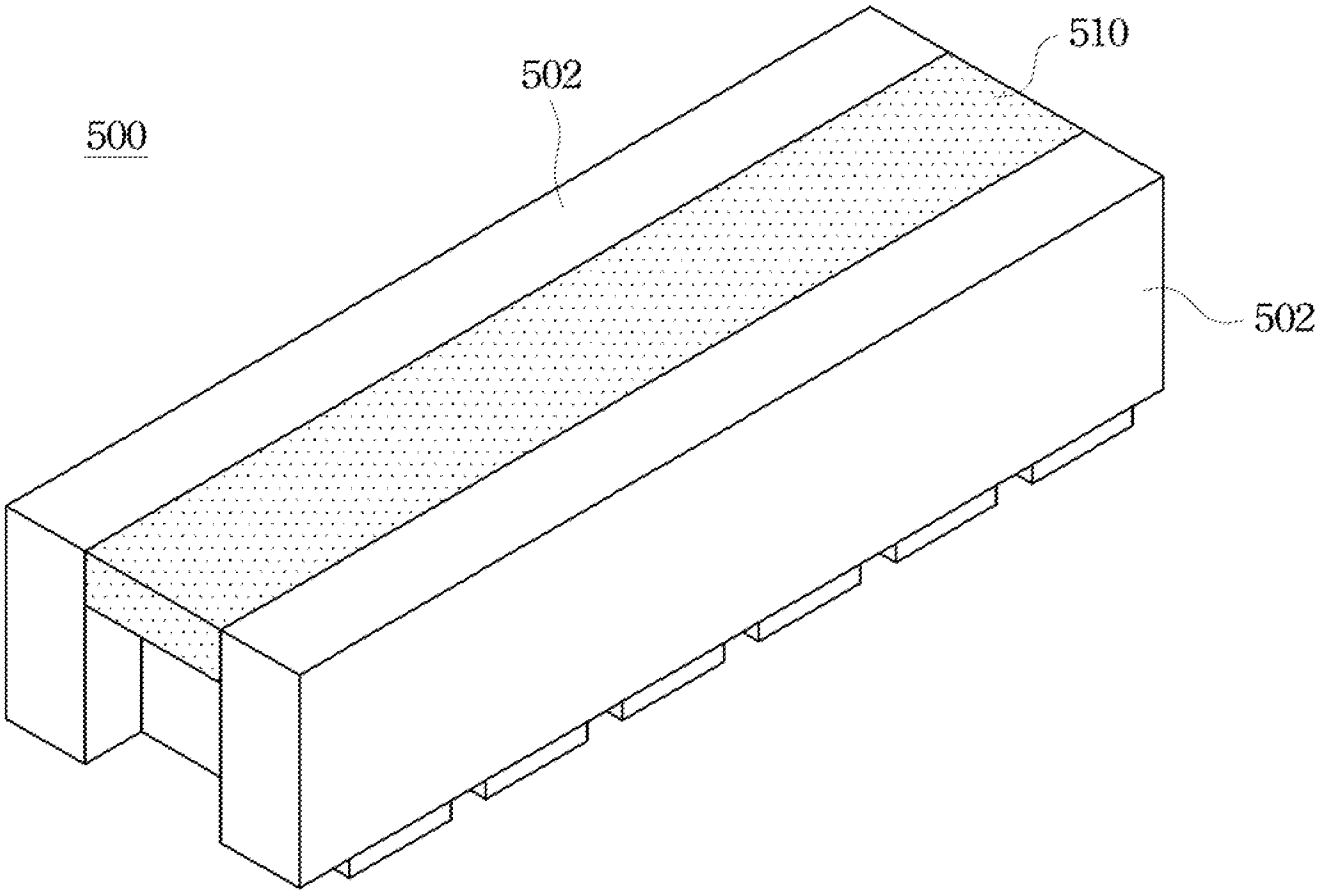
FIG. 9A is a diagram illustrating a perspective view of a magnetic device according to another embodiment of the present invention.
Figure 9B:
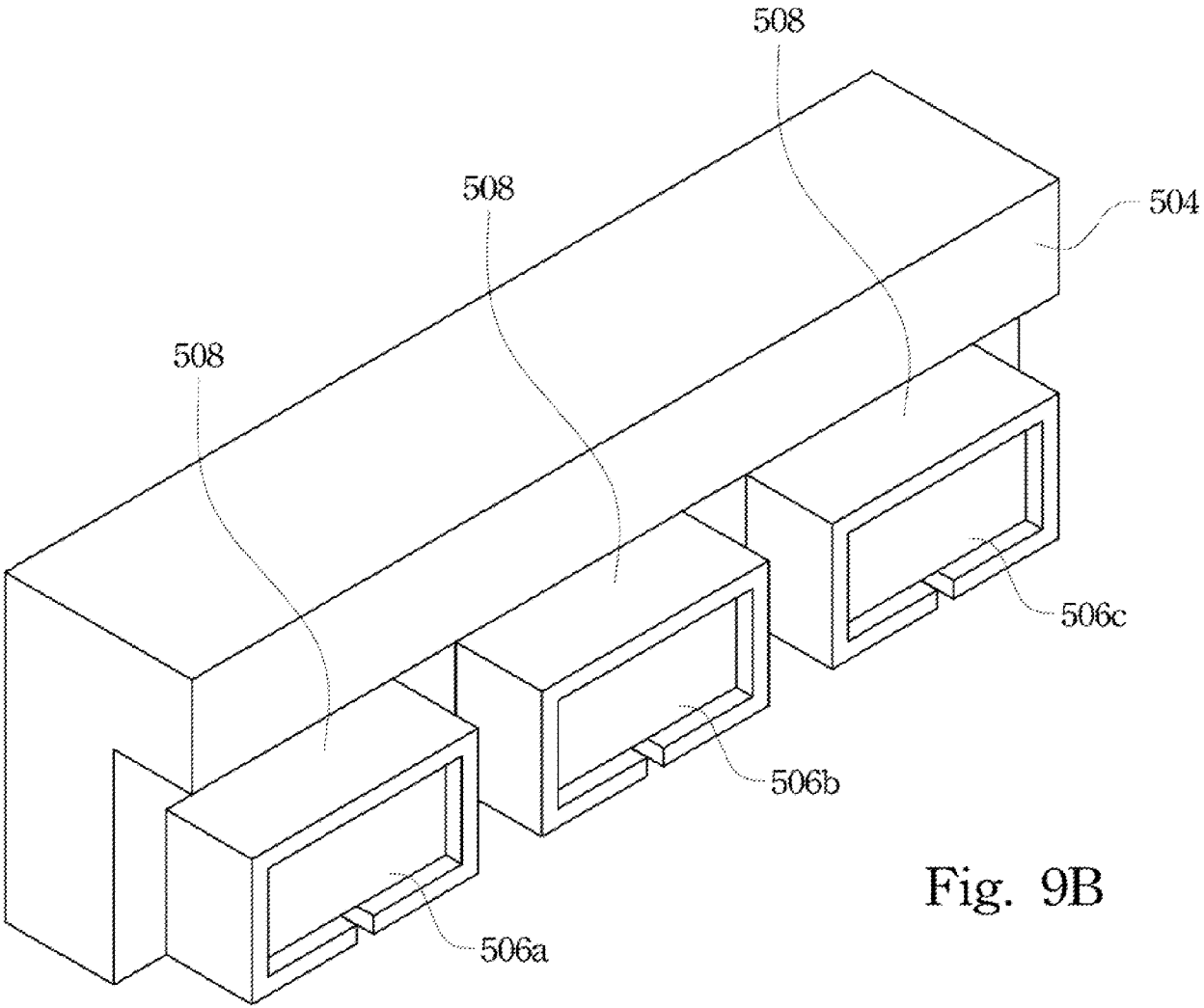
FIG. 9B is a diagram illustrating a perspective view of one magnetic core of the magnetic device shown in FIG. 9A according to one embodiment of the present invention, in which the magnetic core is shown surrounded by windings.

For example, if the member with low magnetic permeability is implemented by a gap, the magnetic device can be made according to FIG. 5 and its related embodiments; on the other hand, if the member with low magnetic permeability is implemented by a magnetic particle colloid, the magnetic device can be made according to FIG. 9A and FIG. 9B, illustrated below, and its related embodiments.

FIG. 9A is a diagram illustrating a perspective view of a magnetic device according to another embodiment of the present invention. FIG. 9B is a diagram illustrating a perspective view of one magnetic core of the magnetic device shown in FIG. 9A according to one embodiment of the present invention, in which the magnetic core is shown surrounded by windings. For purposes of illustration, reference to FIG. 9A and FIG. 9B is made. The magnetic core 500 includes two symmetric magnetic cores 502, a plurality of windings 508 and a magnetic particle colloid 510. Each of the two symmetric magnetic cores 502 includes a first protruding portion 504 and a plurality of second protruding portions 506*a*, 506*b*, 506*c*, in which the first protruding portion 504 is disposed extending along a direction that the second protruding portions 506*a*, 506*b*, 506*c* are arranged. The windings 508 surround the second protruding portions 506*a*, 506*b*, 506*c* respectively. The magnetic particle colloid 510 is disposed between the first protruding portions 504 of the two symmetric magnetic cores 502 after the two symmetric magnetic cores 502 are assembled. In the present embodiment, the magnetic particle colloid 510 may have a lower magnetic permeability than the core material, and the magnetic permeability of the magnetic particle colloid 510 is preferably smaller than 10 so as to avoid a magnetic permeability that is too large which may reduce the anti-saturation capability of a coupled inductor.

The use of the magnetic particle colloid 510 can simplify fabrication, further enhance adhesion between portions of the coupled inductor by the curing and strengthening effect of the magnetic particle colloid 510, and may effectively reduce the interaction between the leakage flux and windings, thus decreasing eddy current loss of windings.

In one embodiment, the first protruding portion 504 may be longer than each of the second protruding portions 506*a*, 506*b*, 506*c*. In another embodiment, any of the second protruding portions 506*a*, 506*b*, 506*c* may be wider than the first protruding portion 504. Consequently, when the two symmetric magnetic cores 502 are assembled, a gap (as shown in FIG. 5) can be formed in the assembly. The magnetic particle colloid 510 can be disposed in the gap, that is, between the first protruding portions 504 of the two symmetric magnetic cores 502.

In yet another embodiment, a distal surface area of the first protruding portion 504 may be larger than distal surface area of each of the second protruding portions 506*a*, 506*b*, 506*c*, and the distal surface areas of the second protruding portions 506*a*, 506*b*, 506*c* can be fabricated to be the same or different according to actual requirements.

In still another embodiment, the magnetizing fluxes induced when the second protruding portions 506*a*, 506*b*, 506*c* are inductively coupled to the windings 508 are inversely coupled to each other. In still yet another embodiment, the leakage fluxes induced when the second protruding portions 506*a*, 506*b*, 506*c* are inductively coupled to the windings 508 pass through the magnetic particle colloid 510. Thus, the magnetizing flux loops and the leakage flux loops are located in two different intersected planes. Preferably, the magnetizing flux loops and the leakage flux loops are located in two different planes perpendicular to each other (as shown in FIG. 8A and FIG. 8B).

On the other hand, in order to concentrate the leakage flux due to the magnetic particle colloid 510 and to decrease eddy current loss of the windings 508, in one embodiment, any two adjacent windings 508 surrounding the second protruding portions 506*a*, 506*b*, 506*c* have a sub gap therebetween, and a reluctance corresponding to the sub gap is greater than ten times the reluctance corresponding to the magnetic particle colloid 510 (or the member with low magnetic permeability). The reluctance corresponding to the sub gap is $R_s=I_s/\mu_0 A_s$, where $I_s$ is the length of the gap and $A_s$ is the cross-sectional area of the gap. The reluctance corresponding to the magnetic particle colloid 510 (or the member with low magnetic permeability) is $R_p=I_p/\mu_p\mu_0 A_p$, where $\mu_p$ is magnetic permeability of the magnetic particle colloid 510, $I_p$ is the length of the magnetic particle colloid 510 (or the member with low magnetic permeability), and $A_p$ is the upper surface area of the magnetic particle colloid 510 (or the member with low magnetic permeability). When the magnetic device is situated in the air, the magnetic permeability $\mu_p$ is 1, such that the reluctance corresponding to the magnetic particle colloid 510 (or the member with low magnetic permeability) can be equivalent to $R_p=I_p/\mu_0 A_p$.

The magnetic device can be made having one or more of the structures and operations described in the foregoing embodiments. For example, each of the second protruding portions 506*a*, 506*b*, 506*c* can be configured to be wider than the first protruding portion 504, and at the same time, the distal surface area of the first protruding portion 504 can be configured to be larger than the distal surface area of each of the second protruding portions 506*a*, 506*b*, 506*c*. Therefore, the foregoing embodiments describing respective structures or operations are only for purposes of illustration and are not limiting of the present invention. All the embodiments can be selectively implemented based on actual requirements to manufacture the magnetic device in the present disclosure.

The foregoing features of structures or operations can be implemented in the magnetic device including the member with low magnetic permeability in the embodiments of the present invention. For purposes of illustration, the foregoing descriptions are made with reference to the embodiments shown in FIG. 9A and FIG. 9B, but are not limiting of the present invention.

Figure 10A:
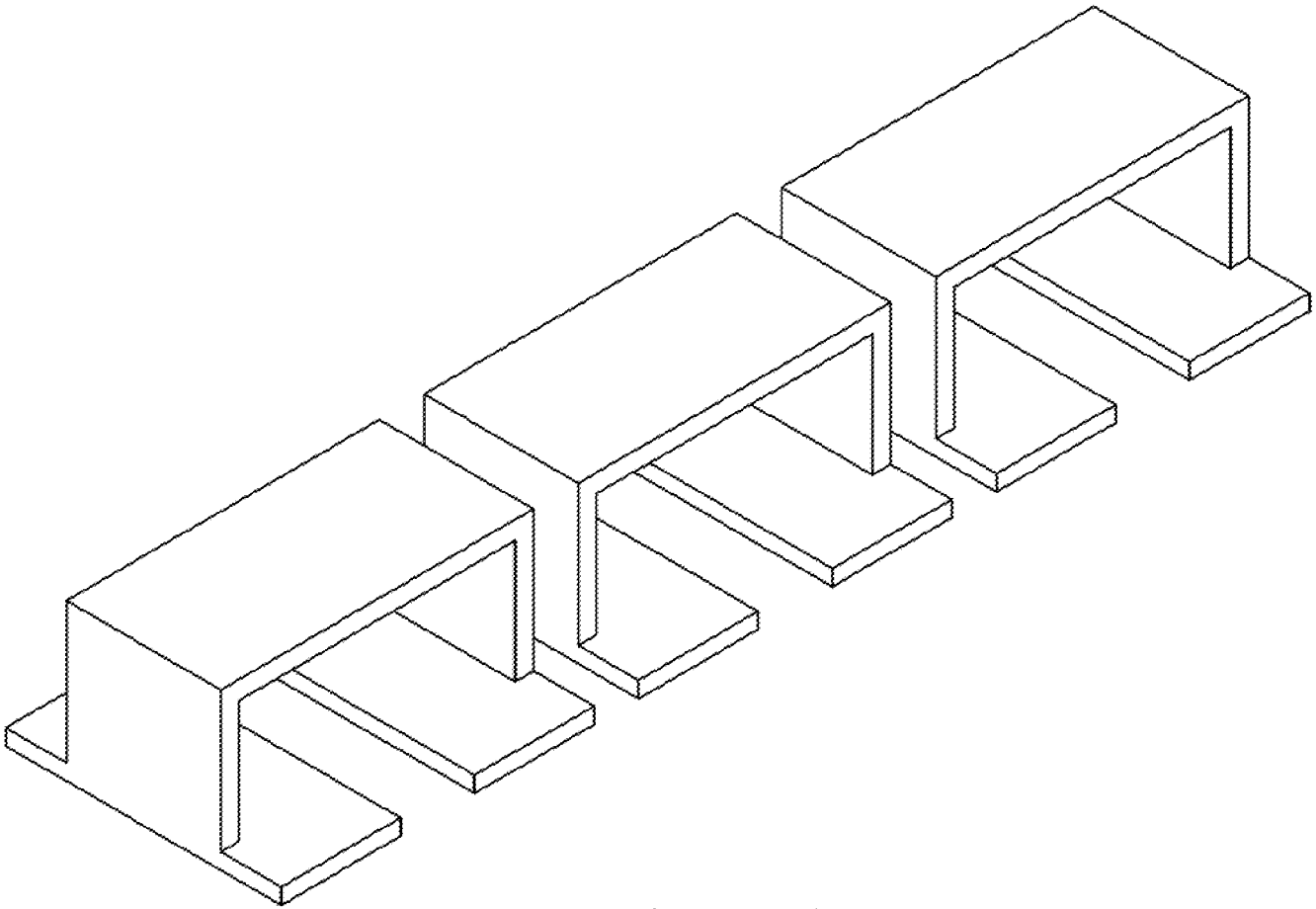
FIG. 10A is a diagram illustrating a perspective view of a winding according to one embodiment of the present invention.
Figure 10B:
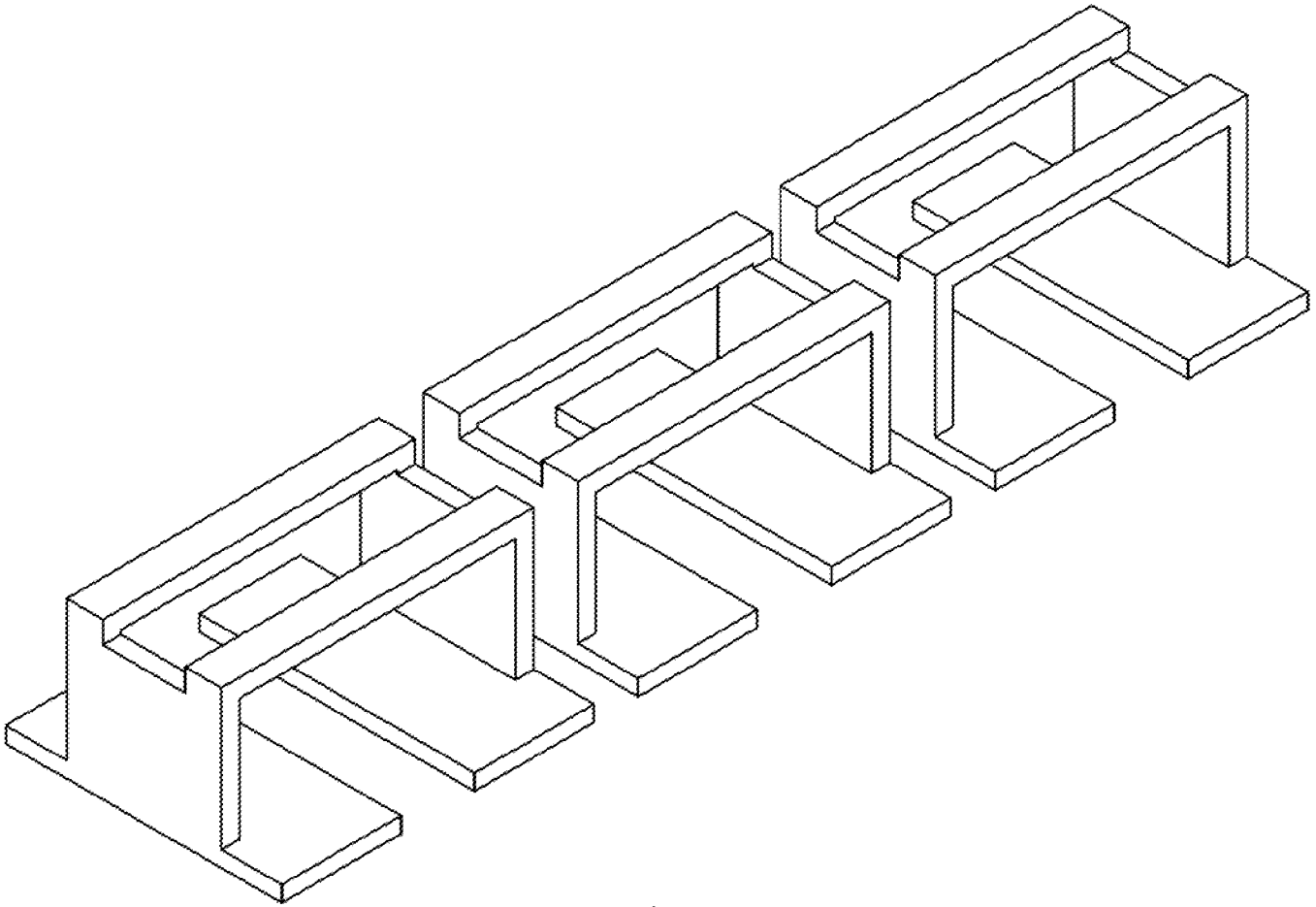
FIG. 10B is a diagram illustrating a perspective view of a winding according to another embodiment of the present invention.

In addition, the windings also can be disposed in the magnetic device in different aspects. FIG. 10A is a diagram illustrating a perspective view of a winding according to one embodiment of the present invention. Specific structures of the windings mentioned above can be made as shown in FIG. 10A. As a result, cross-sectional areas of the coupled inductor can be increased. FIG. 10B is a diagram illustrating a perspective view of a winding according to another embodiment of the present invention. Furthermore, specific structures of the windings mentioned above can be made as shown in FIG. 10B, in which a hole is formed in a portion of each of the windings to decrease the effect of the magnetic flux which is spread from the member with low magnetic permeability (or main gap, or magnetic particle colloid) influencing the windings, thus reducing the loss of windings.

Figure 11A:
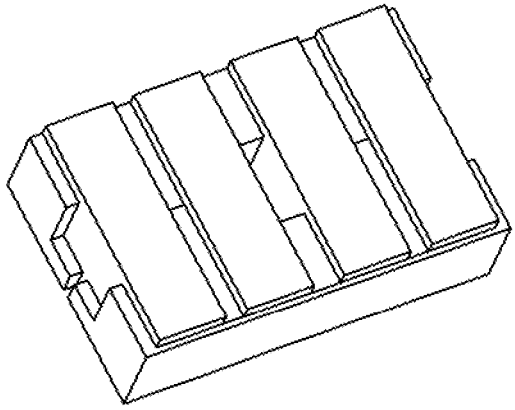
FIGS. 11A-11E are diagrams respectively illustrating perspective views of various magnetic devices according to embodiments of the present invention.
Figure 11B:
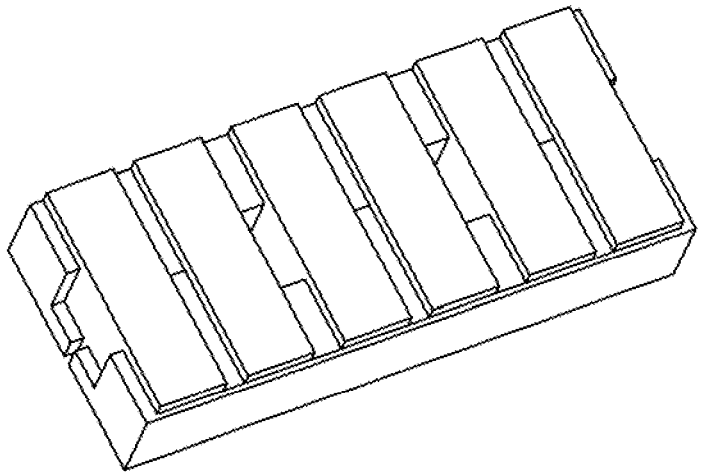
Figure 11C:
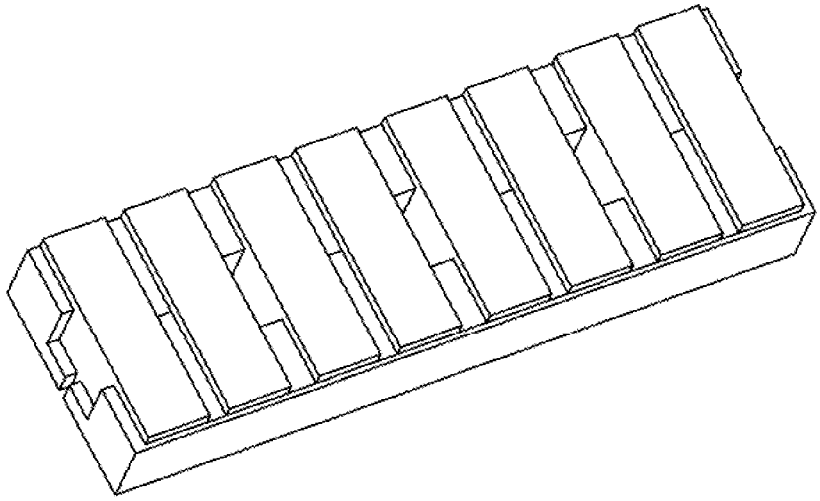
Figure 11D:
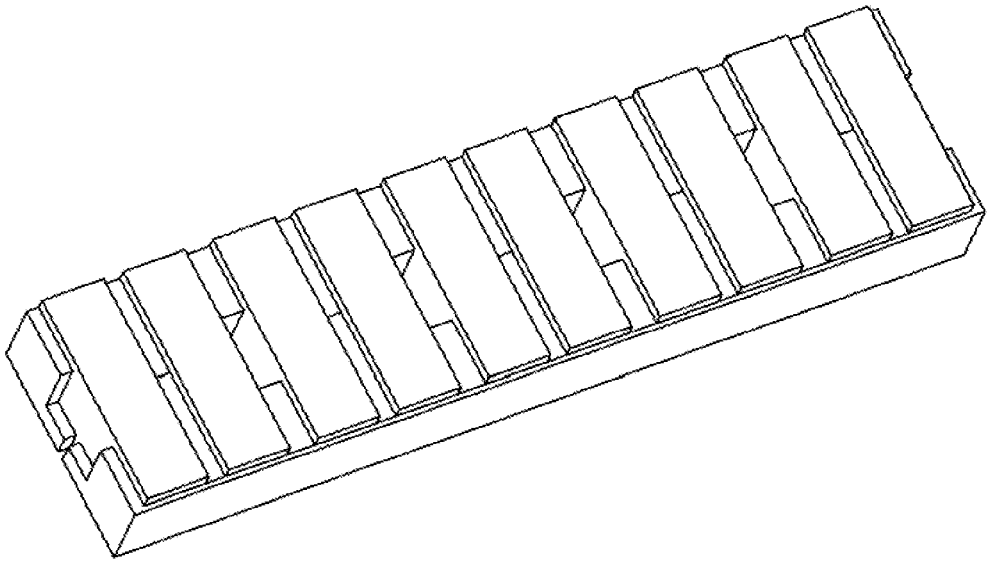
Figure 11E:
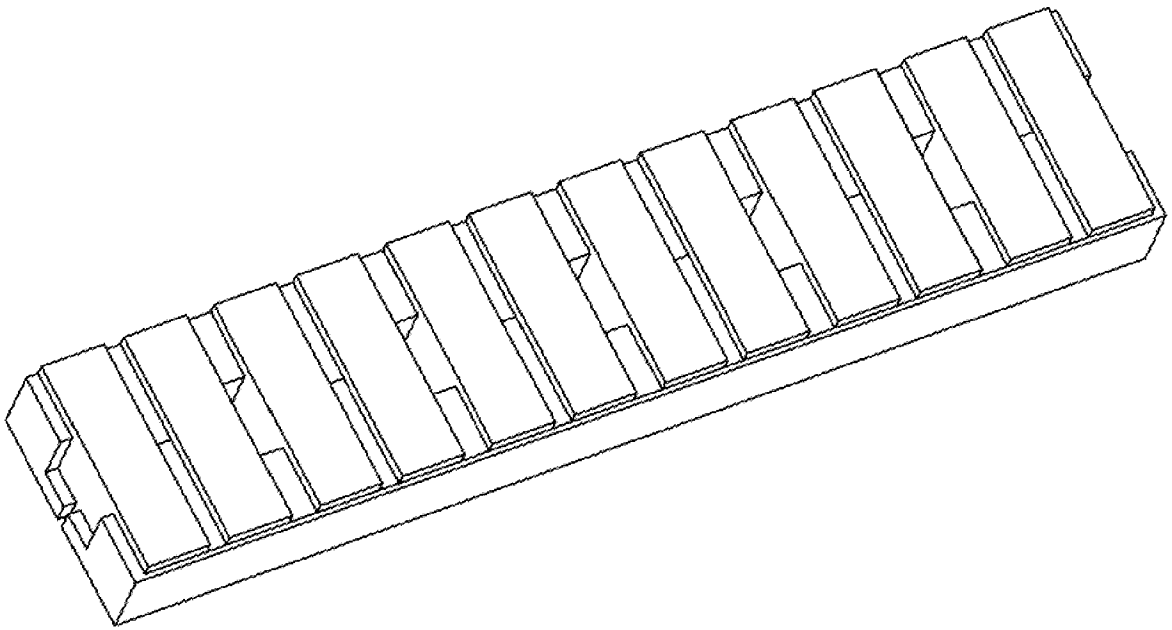

Although the disclosure mentioned above is related to a three-way (or three-phase) magnetic device (e.g., a coupled inductor), persons of ordinary skill in the art also can design various magnetic devices based on actual requirements, as shown in the following FIGS. 11A-11E. FIGS. 11A-11E are diagrams respectively illustrating perspective views of various magnetic devices according to embodiments of the present invention. Specifically, FIG. 11A is a diagram illustrating a perspective view of a magnetic device with a two-phase coupled inductor, FIG. 11B is a diagram illustrating a perspective view of a magnetic device with a three-phase coupled inductor, FIG. 11C is a diagram illustrating a perspective view of a magnetic device with a four-phase coupled inductor, FIG. 11D is a diagram illustrating a perspective view of a magnetic device with a five-phase coupled inductor, and FIG. 11E is a diagram illustrating a perspective view of a magnetic device with a six-phase coupled inductor.

Figure 12A:
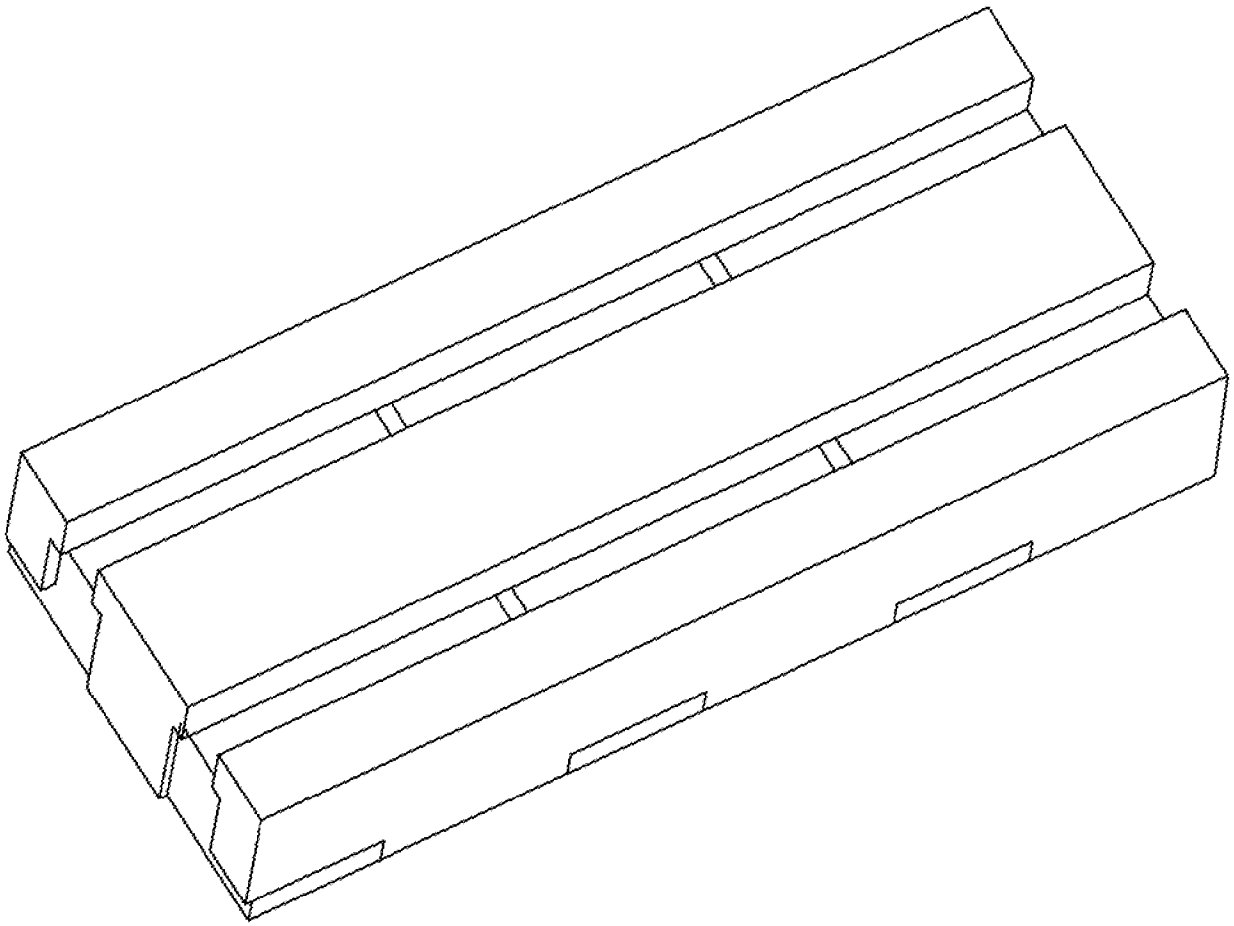
FIG. 12A is a diagram illustrating a perspective view of a magnetic device according to one embodiment of the present invention.
Figure 12B:
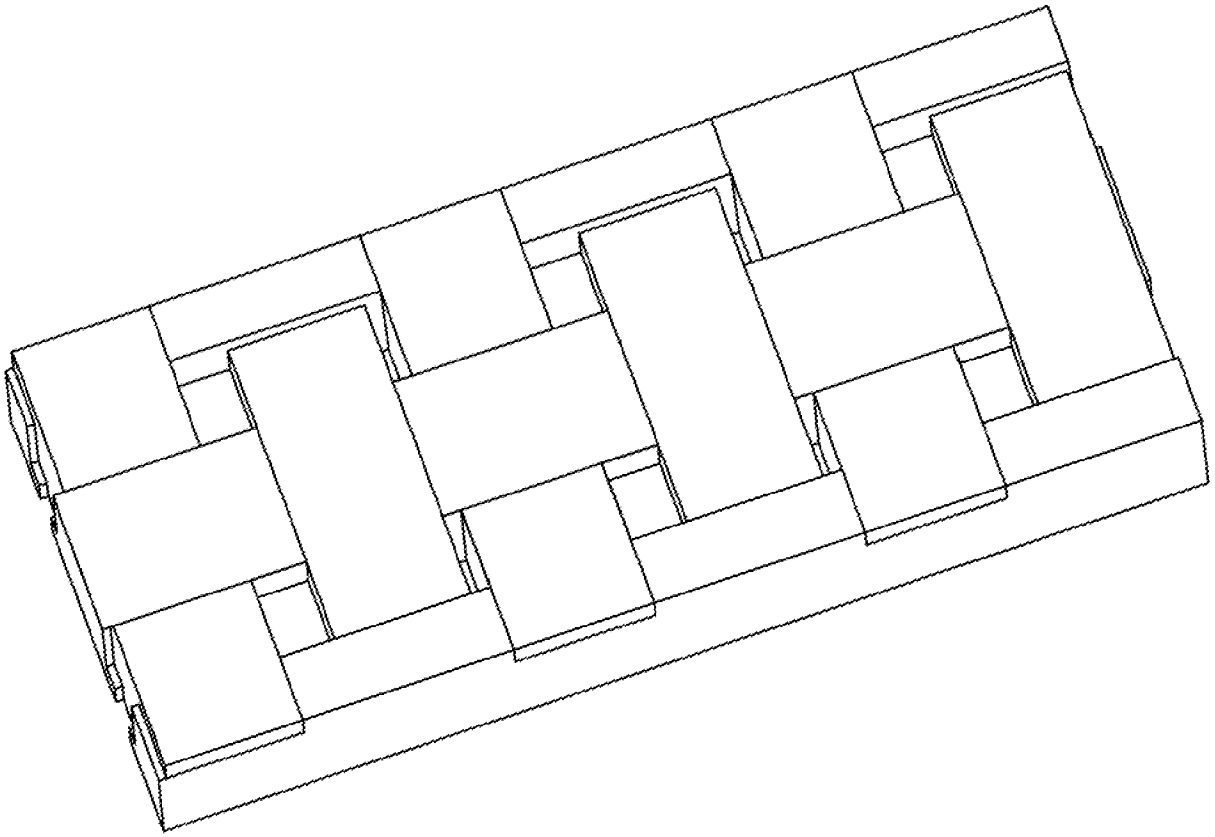
FIG. 12B is a diagram illustrating a bottom view of the magnetic device shown in FIG. 12A.

Moreover, the magnetic device also can be made by a process of assembling elements together, as shown in the following FIG. 12A and FIG. 12B. FIG. 12A is a diagram illustrating a perspective view of a magnetic device according to one embodiment of the present invention, in which the magnetic device mainly includes a symmetric assembly of the two magnetic devices similar to that shown in FIG. 5 or FIG. 9A. FIG. 12B is a diagram illustrating a bottom view of the magnetic device shown in FIG. 12A. Therefore, an area of the magnetic path shared by the windings can be increased, so as to decrease the reluctance of the magnetic path shared by the windings and enhance the magnetizing inductance $L_m$, further increasing output current.

Figure 13:
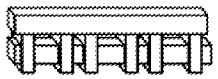
FIG. 13 is a diagram illustrating a comparison table of electrical characteristics measured with configurations of a conventional magnetic device and the magnetic device in the embodiments of the present invention.
Figure 13:
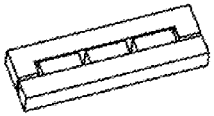
Figure 13:
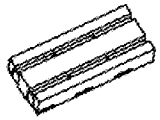
Figure 13:
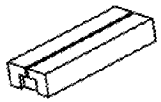

FIG. 13 is a diagram illustrating a comparison table of electrical characteristics measured with configurations of a conventional magnetic device and the magnetic device in the embodiments of the present invention. As shown in FIG. 13, the configuration of the magnetic device in the embodiment of the present invention contributes to an increase in power density. Moreover, direct-current resistance (DCR) of windings is smaller, and the magnetizing inductance $L_m$ (e.g., L1, L2, or L3) is also larger and more uniform than that in the conventional magnetic device.

Another aspect of the present invention is to provide a method for generating inductance. The method comprises the steps outlined in the sentences that follow. A plurality of magnetizing flux loops are induced, in which magnetizing fluxes in any two of the magnetizing flux loops are inversely coupled to each other. Leakage flux loops are induced, in which a plane in which the leakage flux loops are located is different from and intersected with a plane in which the magnetizing flux loops are located.

In one embodiment, the magnetizing flux loops are induced in the magnetic device by two symmetric magnetic cores and a plurality of windings surrounding the two symmetric magnetic cores, and the leakage flux loops pass through a member with low magnetic permeability and which is disposed between the two symmetric magnetic cores of the magnetic device. In another embodiment, the plane in which the leakage flux loops are located is perpendicularly intersected with the plane in which the magnetizing flux loops are located (as shown in FIG. 8A and FIG. 8B).

Yet another aspect of the present invention is to provide a method for generating inductance. The method comprises the steps outlined in the sentences that follow. A plurality of protruding portions of two symmetric magnetic cores are inductively coupled to a plurality of windings surrounding the protruding portions to induce a plurality of magnetizing flux loops, in which magnetizing fluxes in any two of the magnetizing flux loops are inversely coupled to each other. The protruding portions of the two symmetric magnetic cores are inductively coupled to the windings to induce leakage flux loops, in which the leakage flux loops and the magnetizing flux loops are located in two different intersected planes.

In one embodiment, the leakage flux loops and the magnetizing flux loops are located in two perpendicularly intersected planes (as shown in FIG. 8A and FIG. 8B).

The steps are not necessarily recited in the sequence in which the steps are performed. That is, unless the sequence of the steps is expressly indicated, the sequence of the steps is interchangeable, and all or part of the steps may be simultaneously, partially simultaneously, or sequentially performed.

For the foregoing embodiments, the magnetic device or method for generating inductance can be employed to reduce the volume necessary for fabrication and to increase power density, and even can significantly shorten the distance between windings, contribute to enhanced coupling of windings, and generate larger magnetizing inductance with the same size, because magnetizing flux and leakage flux are not located in the same plane.

Furthermore, the lengths of windings can be shortened to reduce direct-current resistance (DCR) of the windings, and the leakage inductance is concentrated in the same member with low magnetic permeability (e.g., the magnetic particle colloid 510 or gap), which allows for simple adjustment to the leakage inductance by varying the member with low magnetic permeability.

Moreover, the distribution of each phase of leakage inductance can be very uniform and easily implemented as a result of the fact that two identical magnetic cores can be made by only one mold, and subsequently assembled to form the magnetic device.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded with the broadest interpretation so as to encompass all such modifications and similar structures.

What is claimed is:

1. An integrated multi-phase coupled inductor comprising:

two symmetric magnetic cores, each of the two symmetric magnetic cores comprising a base, a first protruding portion and a plurality of second protruding portions, the first protruding portion and the second protruding portions being formed on the base separately along two edges of the base, the first protruding portion being formed substantially in parallel with the second protruding portions, the two symmetric magnetic cores being assembled such that a gap is formed between the first protruding portion of one of the two symmetric magnetic cores and the first protruding portion of the other one of the two symmetric magnetic cores.

2. The integrated multi-phase coupled inductor as claimed in claim 1, wherein the first protruding portion is disposed extending along a direction that the second protruding portions are arranged and is longer than each of the second protruding portions.

3. The integrated multi-phase coupled inductor as claimed in claim 1, wherein each of the second protruding portions is wider than the first protruding portion.

4. The integrated multi-phase coupled inductor as claimed in claim 1, wherein a distal surface area of the first protruding portion is larger than a distal surface area of each of the second protruding portions.

5. The integrated multi-phase coupled inductor as claimed in claim 1, wherein distal surface areas of the second protruding portions are the same.

6. An integrated multi-phase coupled inductor comprising:

two symmetric magnetic cores, each of the two symmetric magnetic cores comprising a first protruding portion and a plurality of second protruding portions, the first protruding portion being disposed extending along a direction that the second protruding portions are arranged, the first protruding portions;

a plurality of windings surrounding the second protruding portions respectively; and a member with low magnetic permeability disposed between the first protruding portion of one of the two symmetric magnetic cores and the first protruding portion of the other one of the two symmetric magnetic cores.

7. The integrated multi-phase coupled inductor as claimed in claim 6, wherein the member with low magnetic permeability comprises at least one of a gap and a magnetic particle colloid.

8. The integrated multi-phase coupled inductor as claimed in claim 6, wherein the first protruding portion is longer than each of the second protruding portions, and each of the second protruding portions is wider than the first protruding portion.

9. The integrated multi-phase coupled inductor as claimed in claim 6, wherein a distal surface area of the first protruding portion is larger than a distal surface area of each of the second protruding portions.

10. The integrated multi-phase coupled inductor as claimed in claim 6, wherein the second protruding portions are inductively coupled to the windings to induce magnetizing flux loops and leakage flux loops, and the magnetizing flux loops and the leakage flux loops are located in two different intersected planes.

11. The integrated multi-phase coupled inductor as claimed in claim 6, wherein the second protruding portions are inductively coupled to the windings to induce magnetizing fluxes, and the magnetizing fluxes are inversely coupled with one another.

12. The integrated multi-phase coupled inductor as claimed in claim 6, wherein the second protruding portions are inductively coupled to the windings to induce a leakage flux passing through the member with low magnetic permeability.

13. The integrated multi-phase coupled inductor as claimed in claim 6, wherein any adjacent two of the windings surrounding the second protruding portions have a sub gap therebetween, and a reluctance corresponding to the sub gap is greater than ten times the reluctance corresponding to the member with low magnetic permeability.

14. An integrated multi-phase coupled inductor comprising:

two symmetric magnetic cores, each of the two symmetric magnetic cores comprising a first protruding portion and a plurality of second protruding portions, the first protruding portion being disposed extending along a direction that the second protruding portions are arranged, the first protruding portion being formed substantially in parallel with the second protruding portions, the first protruding portion being longer than each of the second protruding portions, each of the second protruding portions being wider than the first protruding portion;

a plurality of windings surrounding the second protruding portions respectively; and a magnetic particle colloid disposed between the first protruding portion of one of the two symmetric magnetic cores and the first protruding portion of the other one of the two symmetric magnetic cores.

15. The integrated multi-phase coupled inductor as claimed in claim 14, wherein a distal surface area of the first protruding portion is larger than a distal surface area of each of the second protruding portions.

16. The integrated multi-phase coupled inductor as claimed in claim 14, wherein distal surface areas of the second protruding portions are the same.

17. The integrated multi-phase coupled inductor as claimed in claim 14, wherein the second protruding portions are inductively coupled to the windings to induce magnetizing flux loops and leakage flux loops, and the magnetizing flux loops and the leakage flux loops are located in two different intersected planes.

18. The integrated multi-phase coupled inductor as claimed in claim 17, wherein the magnetizing flux loops and the leakage flux loops are located in two perpendicularly intersected planes.

19. The integrated multi-phase coupled inductor as claimed in claim 14, wherein the second protruding portions are inductively coupled to the windings to induce magnetizing fluxes, and the magnetizing fluxes are inversely coupled with one another.

20. The integrated multi-phase coupled inductor as claimed in claim 14, wherein the second protruding portions are inductively coupled to the windings to induce a leakage flux passing through the member with low magnetic permeability.

21. A method for generating inductance, the method comprising:

inducing a plurality of magnetizing flux loops, wherein magnetizing fluxes in any two of the magnetizing flux loops are inversely coupled to each other; and inducing leakage flux loops, wherein a plane in which the leakage flux loops are located is different from and intersected with a plane in which the magnetizing flux loops are located.

22. The method as claimed in claim 21, wherein the magnetizing flux loops are induced by two symmetric magnetic cores of an integrated multi-phase coupled inductor and a plurality of windings surrounding the two symmetric magnetic cores, and the leakage flux loops pass through a member with low magnetic permeability and which is disposed between the two symmetric magnetic cores of the magnetic device.

23. The method as claimed in claim 21, wherein the plane in which the leakage flux loops are located is perpendicularly intersected with the plane in which the magnetizing flux loops are located.

24. A method for generating inductance, the method comprising:

coupling inductively a plurality of protruding portions of two symmetric magnetic cores to a plurality of windings surrounding the protruding portions to induce a plurality of magnetizing flux loops, wherein magnetizing fluxes in any two of the magnetizing flux loops are inversely coupled to each other; and coupling inductively the protruding portions of the two symmetric magnetic cores to the windings to induce leakage flux loops, wherein the leakage flux loops and the magnetizing flux loops are located in two different intersected planes.

25. The method as claimed in claim 24, wherein the leakage flux loops and the magnetizing flux loops are located in two perpendicularly intersected planes.

* * * * *